US005467761A

United States Patent [19]

Kuechler

[11] Patent Number: 5,467,761

[45] Date of Patent: Nov. 21, 1995

[54] APPARATUS AND METHOD FOR REMOVING FUMES FROM THE SPACE ABOVE A COOKING APPLIANCE

[75] Inventor: Irv Kuechler, San Bernardino, Calif.

[73] Assignee: D.E.R. Investments Ltd., Chicago, Ill.

[21] Appl. No.: 105,295

[22] Filed: Aug. 11, 1993

[51] Int. Cl.[6] ..... F24C 15/20; F23J 11/02

[52] U.S. Cl. ..... 126/299 D; 126/299 R; 55/DIG. 36

[58] Field of Search ..... 126/299 R, 299 D; 55/DIG. 36

[56] References Cited

U.S. PATENT DOCUMENTS

| | | | |
|---|---|---|---|
| 3,664,255 | 5/1972 | Kuechler | 126/299 D |
| 3,943,836 | 3/1976 | Kuechler | 126/299 B |
| 4,011,802 | 3/1977 | Molitor et al. | 126/299 R |
| 4,186,727 | 2/1980 | Kaufman et al. | 126/299 D |
| 4,346,692 | 8/1982 | McCauley | 126/299 D |
| 4,811,724 | 3/1989 | Aalto et al. | 126/299 D |

FOREIGN PATENT DOCUMENTS

| | | | |
|---|---|---|---|
| 3601864 | 7/1987 | Germany | 126/299 D |

*Primary Examiner*—Carl D. Price
*Attorney, Agent, or Firm*—Dvorak and Traub

[57] ABSTRACT

An apparatus for filtering grease laden fumes in the space above a cooking appliance, including a hood, a supply air plenum and an exhaust air plenum on each side of the hood, a source of air under pressure being connected to a supply air transition duct connected by an air supply transition duct coupled to an opening in the air supply plenum, the supply air plenum being provided with perforated balancing plates which perform the function of modulating the incoming air to flow in a particular manner, and further being provided with perforated deflector pairs of overlapped plates positioned below the balancing plates, to additionally modulate the air flow paths, so that straight paths of air flow move into the interior of the hood above the cooking appliances and then pass through filters which remove grease particles as the exhaust air moves through the filters into the exhaust air plenum. An equalizer vane member is secured to shroud the exhaust air passing through the filters, the equalizer vane member being provided with an exhaust opening which communicates with an exhaust air plenum, the exhaust air under said equalizer vane member being conducted toward the exhaust opening which registers with an opening in an exhaust air transition duct which is coupled to an exhaust duct communicating with a source of exhaust suction.

25 Claims, 4 Drawing Sheets

FIG. 2
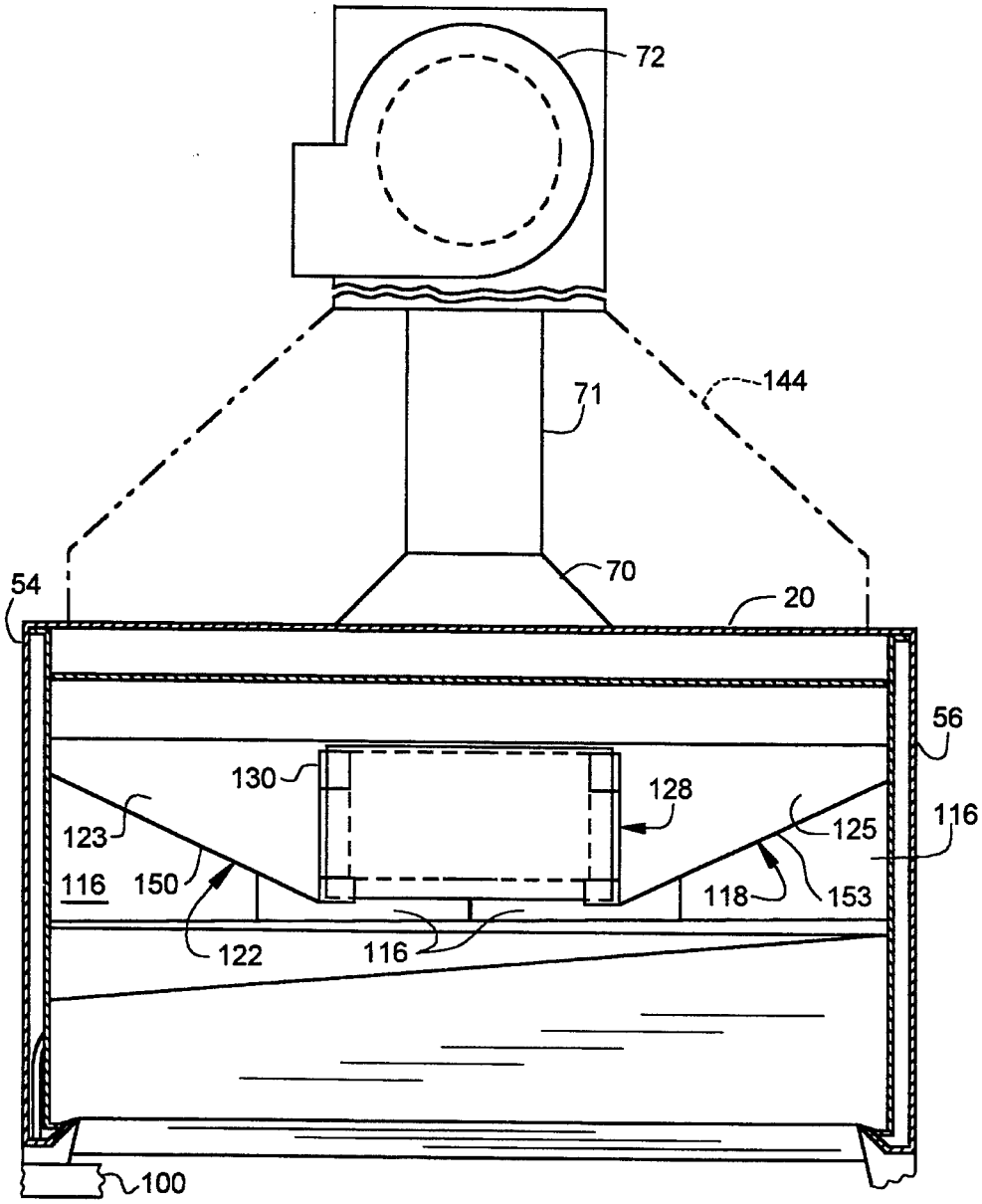
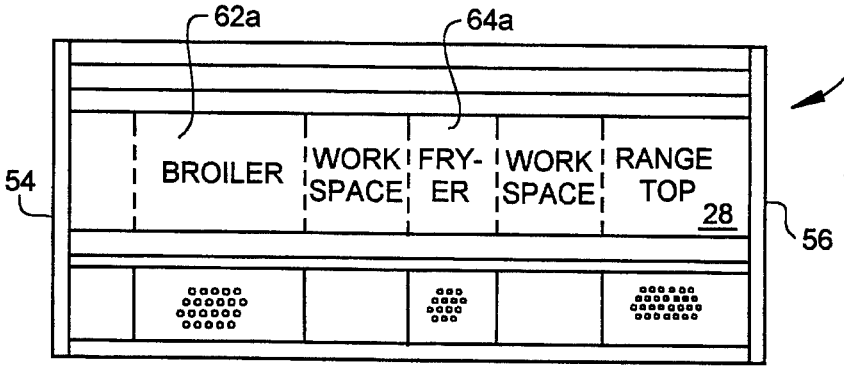
FIG. 3

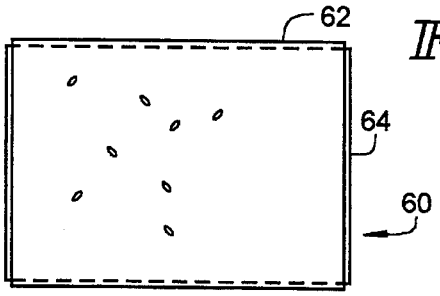
FIG. 8
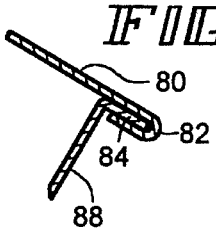
FIG. 11
FIG. 9A
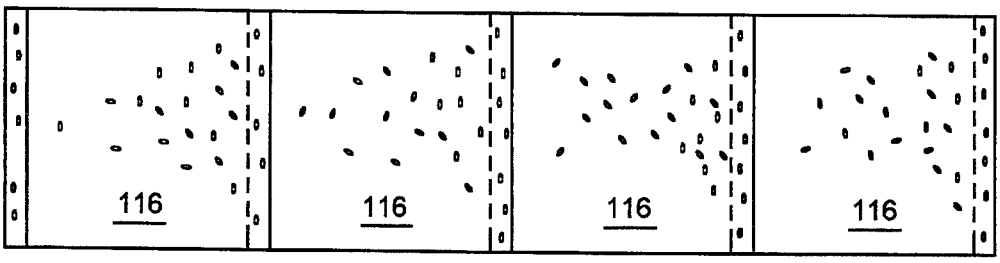
FIG. 9B
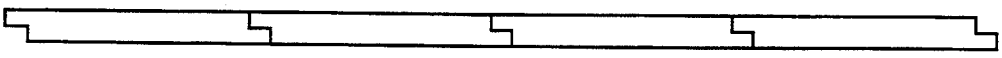
FIG. 10
PRIOR ART
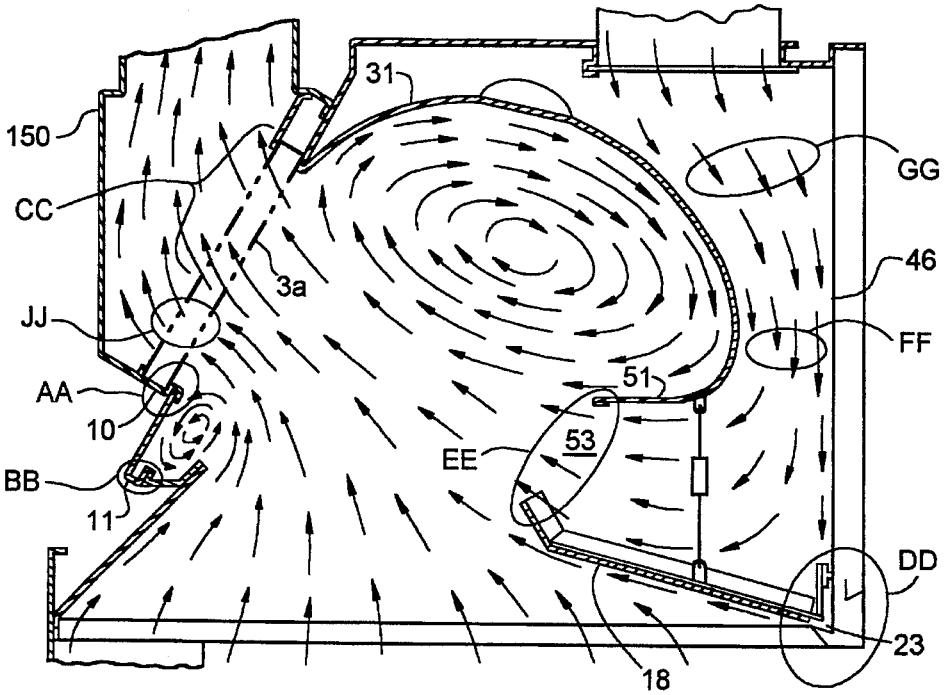

APPARATUS AND METHOD FOR REMOVING FUMES FROM THE SPACE ABOVE A COOKING APPLIANCE

BACKGROUND OF THE INVENTION

1. Field of the Invention

This invention relates to the field of ventilator hoods for removing airborne grease and smoke from spaces above cooking appliances, particularly in the kitchens of catering businesses and restaurants.

2. Description of the Prior Art

An earlier development of an apparatus for removing fumes from a space above a cooking appliance has been described in U.S. Pat. No. 3,943,836, issued Mar. 16, 1976, wherein there is described a vortex-type smoke ventilator wherein the incoming supply of air is caused to swirl and mix with uprising fumes before being exited through filters into an exhaust duct. However, this apparatus had certain disadvantages in that the swirling air developed under the hood did not have sufficient velocity to break down large grease particles on its way to be passed through a filter, thus causing the larger globules of grease to adhere to the surface of the filter, eventually causing a grease film to develop over the entire surface of the filter. When a globule of grease is captured by the swirling air, it is bound to be diminished in size before it approaches the filter to pass through it and exit through the exhaust duct.

The faster the air flows in a vortex below the hood, the more effective is the centrifugal grease-separation action in the apparatus.

Another disadvantage of the known apparatus was the lack of control exerted over the supplied air passing through the hood volume, so that all of the supplied air entering the hood volume would depart through the filters downwards through the exhaust duct. Too much supplied air would cause some of the supplied air to leave the hood volume and enter into the interior of the kitchen carrying some of the fumes with the supplied air. The best procedure is to have almost all of the supplied air enter the hood volume and mix with the fumes and depart through the filters into the exhaust duct. On the other hand, if too much supplied air is exhausted through the exhaust duct, some of the heat in the kitchen area will be drawn and pass through the exhaust duct. In a general arrangement, the apparatus is about 10 feet long and incorporates three cooking sections. For example, starting from the left side, there is a workspace, followed by a broiler, followed by another workspace, followed by a fryer, followed by a workspace, and terminating in a range top. To improve the flow of air flowing over the spaces occupied by the broiler, the fryer, and the range top, it is desirable to provide compensator air plates adjacent the cooking areas, the compensator plates being provided with a multiple number of openings which are adapted to be reduced in size with another overlapping compensator plate to adjust the flow of air above the broiler, the fryer, and range top areas. To improve the grease-collecting features of a bank of abutting filters, the filters should not be coupled by coupling members, which reduce the filtering area, thereby permitting all of the air to flow through and permit particulate matter to be trapped by the filters. Also, the efficiency of the hood is increased because the uniformity of the baffle spacing of the full length of the filter bank achieves uniform laminar flow, whereas the conventional filter arrangement has unequal side margins, and filler panels are necessary. These filler panels deflect the incoming supplied air downward, thereby reducing the air volume capacity of the hood. In the earlier apparatus, an upwardly extending exhaust plenum would extend across the full length of the hood and slope upwardly and inwardly until the reduced opening at the top of the plenum would connect with a duct leading to an exhaust fan. To simplify the construction of the apparatus, a horizontally extended exhaust plenum interconnects with an exhaust air duct. Therefore, this arrangement saves considerable time in preparing the apparatus, and at the same time, saving in time and material construction. An equalizer vane member is used in conjunction with the horizontally extended exhaust plenum and replaces the former bulky and extensive exhaust plenum. The equalizer vane member achieves the same results as the upwardly extending exhaust plenum by restricting the exhaust air flow more at the center one-third duct penetration section than the left and right one-third sections. This design, which is modular for all lengths of hoods, achieves uniform laminar exhaust air flow the full length of the filter bank. This design feature contributes to the success of the hood by simplifying fabrication and installation.

SUMMARY OF THE INVENTION

The object of the invention is to improve the fume and grease removal in a hood positioned over a cooking appliance.

Another object of the invention is to simplify the construction of the supply air and exhaust air flow channels.

A method of removing cooking fumes and odors from the area above a cooking appliance located in a kitchen area, wherein supplied air passes through a supply air plenum into the interior of the hood partly defined by a vortex liner and exists through filter means in an exhaust plenum and is then exhausted exteriorly of the kitchen area. The method comprises modulating the flow of the supply air through the supply air plenum, smoothly directing the flow from the supply air plenum toward a chamber in the hood, deflecting and increasing the velocity of the supply air to create a vortex flow to capture rising fumes and smoke entering the hood chamber, directing the supply air contaminated with the fumes and smoke through the filter means into the exhaust plenum, channeling upwardly the exhaust air passing through the filter means, and directing the flow of the exhaust air along a horizontal path toward a transition exhaust duct.

The step of modulating the exhaust air in the supply air plenum comprises passing the supply air through at least one arrangement of horizontally extending perforated plates positioned in the supply air plenum, and wherein the step of achieving smooth flow in the supply air plenum is achieved by baffling the flow of supply air through a throat to deflect the supply air into a vortex liner in the hood.

The step of channeling the exhaust flow through the filter means is obtained by baffling the flow across the full length of the exhaust air plenum, and directing the exhaust air to a centralized transition exhaust duct.

The method also includes the step of controlling the quantity of the supply air introduced into the supply air plenum, and further controlling the amount of exhaust air leaving the exhaust plenum, so that the volume of supply air being provided by a supply blower relative to the exhaust blower is less than the volume of air combined with the fumes and odors which passes through the filter.

The step of modulating the flow of supply air is achieved by inserting perforated plates in the supply air plenum to impart particular flow characteristics to the supply air.

The method also includes the step of positionally adjusting the perforated plates with respect to each other to control the amount of supply air entering the chamber in the hood.

The step of channeling upwardly the exhaust air is achieved by shrouding the filter means with an equalizer vane provided with an exhaust slot communicating with the transition exhaust duct.

An exhaust duct includes an exhaust plenum defined by full lengths of a vortex liner and an exhaust plenum wall. An equalizer vane member, provided with a centrally located exhaust opening, extends longitudinally over a grease filter. A compensator structure is disposed in the supply air plenum, the compensator structure extending between the wall of the vortex liner and a deflecting member, the deflecting member extending longitudinally along the length of the vortex liner and having an edge defining with the wall of the vortex liner, a constricting air vortex-producing throat.

The deflecting member defines a vertical plenum wall and has an arcuate portion connected to an inclined baffle plate having a lip defining the edge. The baffle plate has a base portion which angularly projects upwardly from a perimeter of the bottom of the hood by about 15°, and the lip projects angularly upwardly from the base portion by about 49°, pointing substantially toward a core of the space defined by the vortex liner. The deflecting member is in a form of a perforated deflector plate situated in an upper portion of the supply air plenum, at each end of the plenum, and extending between the wall of the vortex liner and the deflector member, and a plurality of sets of overlapping perforated plates, movable with respect to each other, and extending in a lower portion of the supply air plenum, between the wall of the supply air plenum and the deflecting member. The exhaust air plenum includes a vertical section and an angular downwardly deflected section having a downwardly directed hem, a grease filter disposed below the angular downwardly deflected section and supported from the hem and a support member, and a draining arrangement for collecting the grease. Mounting clips associated with the hem are provided for supporting the filter on the angular downwardly deflector section. The equalizer vane member comprises a plate structure having a minor portion bent at 90° to a major portion and having a central portion provided with an exhaust opening, the major portion having a centrally located section provided with a cut-out, a damper covering said cut-out. A retaining member for slidably retaining the damper on the centrally located section is provided. Vanes extending outwardly from the centrally located section are provided, each vane having an edge angularly extending from a bottom of the centrally located section in a direction outwardly and toward a side of said plate structure to define a truncated triangle. The exhaust opening subtends ⅓ of the length of the plate structure, and the cut-out subtends ⅓ of the length of the plate structure. A support structure supports the plate structure, in the exhaust plenum, above the filter, at a predetermined shrouding position.

The apparatus for filtering fumes in the space above a cooking appliance comprises a hood, a supply air plenum and an exhaust air plenum in the hood. A supply air channel communicates with the supply air plenum for providing a supply of air to the hood. An exhaust air channel communicates with the exhaust air plenum for exhausting contaminated air from the hood. Filter members are provided for filtering grease from said contaminated air. The supply air channel includes a supply air duct, a supply air transition duct, and a perforated deflector structure, the supply air transition duct connecting the supply air duct to the supply air plenum. The perforated deflector structure is disposed in a flow path of the supply air. The exhaust air channel includes an exhaust air duct, an exhaust air transition duct, and an equalizer vane member. The exhaust air transition duct connects the exhaust air duct to the exhaust air plenum, the equalizer vane structure, having a centrally located exhaust opening, being disposed in the exhaust air plenum, and a securing member for securing the equalizer vane structure above the filters, at a predetermined distance therefrom, to direct the exhaust air under the equalizer vane structure toward the exhaust opening. The perforated deflector structure has a pair of perforated plates, a securing member for securing each plate in an upper portion of the supply air plenum at each end of the supply air plenum, a plurality of pairs of overlapping perforated plates, the plates in each pair being movable with respect to each other, and further securing means for securing said pair of plates, spaced from each other, on the same level in a lower portion in the supply air plenum.

The equalizer vane member has a plate structure provided with a minor portion bent at 90° to the major portion and having a central portion provided with an exhaust opening, the major portion having a centrally located section provided with a cut-out, a damper covering said cut-out, support structure for slidably securing the damper on said centrally located section, vanes having swept-back edges, the edges extending upwardly from a bottom of the central section and toward the side of the plate structure to define truncated triangles. The exhaust opening is a slot having a length equal to about the length of the central section. The central portion has a length equal to about ⅓ of the length of the plate structure.

A fume and odor collecting hood is adapted to be mounted above a cooking appliance in a cooking area, including a housing having a hood chamber and a vortex liner adapted to receive fumes and cooking odors generated by the cooking appliance. Grease filter means are mounted in the housing for removing fume and odor permeated air. An exhaust air duct and blower means are provided to draw the permeated air through the filter means from the chamber in the hood for discharge to a region exterior of the cooking area. A supply air duct and blower means are connected to the housing for supplying air directly to the housing from a region exterior of the cooking area. Deflecting means defining one wall of the housing are provided for directing the air supply. The supply air duct means include a supply air plenum defined by full lengths of the vortex liner and the deflecting means. Also, equalizer vane means are furnished with a centrally located air exhaust opening extending longitudinally over the grease filter means.

The supply air duct includes compensator means disposed in the supply air plenum, the compensator means extending between a wall of the vortex liner and the deflecting means, which extend longitudinally along the length of the vortex liner and have a deflector edge defining with an edge of the wall of the vortex liner a constricting air vortex-producing throat.

The deflecting means define a vertical plenum wall and have an arcuate portion connected to an inclined baffle plate having a lip defining the deflector edge.

The baffle plate has a base portion which angularly projects upwardly from a perimeter of the bottom of the hood by about 15°, and the lip projects angularly upwardly from the base portion by about 49°, pointing substantially toward a core of the space defined by the vortex liner.

The compensator means comprise a pair of perforated balancing plates located in the upper portion of the supply air plenum, one at each end of the plenum, and extending between the wall of the vortex liner and the deflection means, and a plurality of sets of overlapped perforated deflector plates are provided, the plates being movable with respect to each other, and extending in a lower portion of the supply air plenum, between the wall of the vortex liner and the deflecting means.

The exhaust air plenum wall means comprise a vertical section and an angular downwardly deflected section having a downwardly directed hem. A grease gutter is disposed below the angular downwardly deflected section and supported from the hem and a support member, and draining means are provided for collecting the grease.

Mounting clips associated with the hem are provided for supporting the filter means on the angular downwardly deflector section.

The equalizer vane means comprise a plate structure having a minor portion bent at 90° to a major portion and having a central portion provided with an exhaust air opening. The major portion has a centrally located section provided with a cut-out, and a damper covering said cut-out. Means are provided for slidably retaining the damper on said centrally located section. Vanes extend outwardly from the centrally located section, each vane having an edge angularly extending from a bottom of the centrally located section in a direction outwardly and toward a side of the plate structure to define a truncated right triangle.

The exhaust air opening subtends ⅓ of the length of the plate structure and the cut-out subtends ⅓ of the length of the plate structure.

Support means are provided for supporting the plate structure in the exhaust air plenum above the filter means at a predetermined shrouding position.

The invention is concerned with an apparatus for filtering fumes in the space above a cooking appliance, a housing defining a hood, a vortex liner contained in the hood, a supply air plenum and an exhaust air plenum in the hood. The supply air means communicate with the supply air plenum for providing a supply of air to the hood. An exhaust air means communicates with the exhaust air plenum for exhausting contaminated air from the hood. Filter means are provided for filtering grease from the contaminated air. The improvement resides in that the supply air means comprises a supply air duct, a supply air transition duct, and compensation means, the supply air transition duct coupling the supply air duct to the supply air plenum, the compensator means being disposed in a flow path of the supply air. The exhaust air means comprise an exhaust air duct, an exhaust air transition duct, and equalizer vane means, the exhaust air transition duct connecting the exhaust air duct to said exhaust air plenum. The equalizer vanes have a centrally located exhaust air opening which is disposed in the exhaust air plenum, and means for securing the equalizer vane means above the filter means, at a predetermined distance therefrom, to direct the exhaust air, under the equalizer vane means, towards the exhaust opening.

The compensator means comprise a pair of perforated balancing plates. Securing means are provided for securing each plate in an upper portion of the supply air plenum at each end of the supply air plenum. A plurality of pairs of overlapping perforated deflector plates are provided, the plates in each pair being movable with respect to each other, and means for securing the pairs of plates, spaced from each other, on the same level in a lower portion in the supply air plenum.

The equalizer vane means comprise a plate structure having a minor portion bent at a 90° angle to a major portion and having a central portion provided with the exhaust air opening, the major portion having a centrally located section provided with a cut-out, a damper covering the cut-out, means for slidably securing the damper on the centrally located section, vanes having swept-back edges, the edges extending outwardly from a bottom of the central section and toward sides of the plate structure to define truncated right triangles.

The exhaust opening has a slot having a length equal to about the length of the central section.

The central portion has a length equal to about ⅓ of the length of the plate structure.

Each supply air transition duct and each exhaust air transition duct extend to about ⅓ of the length of the hood and are centrally located in the hood.

The supply air transition duct communicates with the central portion of the supply air plenum and the exhaust air transition duct communicates with the central portion of the exhaust air plenum.

The exhaust air transition duct registers with the exhaust air opening.

BRIEF DESCRIPTION OF THE DRAWINGS

FIG. 2 is a vertical sectional view taken on line 2—2 of FIG. 1, and looking rearwardly. Such FIG. 2 also illustrates a horizontally extending plenum communicating with an exhaust blower.

FIG. 3 is a section along the line 3—3 of FIG. 1, showing the arrangement of the workspaces and the cooking spaces, including the distribution of the compensator plates adjoining the cooking spaces.

FIG. 8 shows a plane view of a compensator grid plate.

FIG. 9A shows a bank of filters, and FIG. 9B shows an enlarged view of the overlapping filters.

FIG. 10 shows prior art.

FIG. 11 is an enlargement of a joint A shown in FIG. 1.

DESCRIPTION OF THE PREFERRED EMBODIMENT

Except as specifically stated herein, the apparatus is substantially the same as that described and claimed in U.S. Pat. No. 3,943,836 issued Mar. 16, 1976, for "APPARATUS FOR REMOVING FUMES FROM THE SPACE ABOVE A COOKING APPLIANCE IN A RESTAURANT". The disclosure of the foregoing patent is hereby incorporated by reference herein as though set forth in full.

Figure 1:
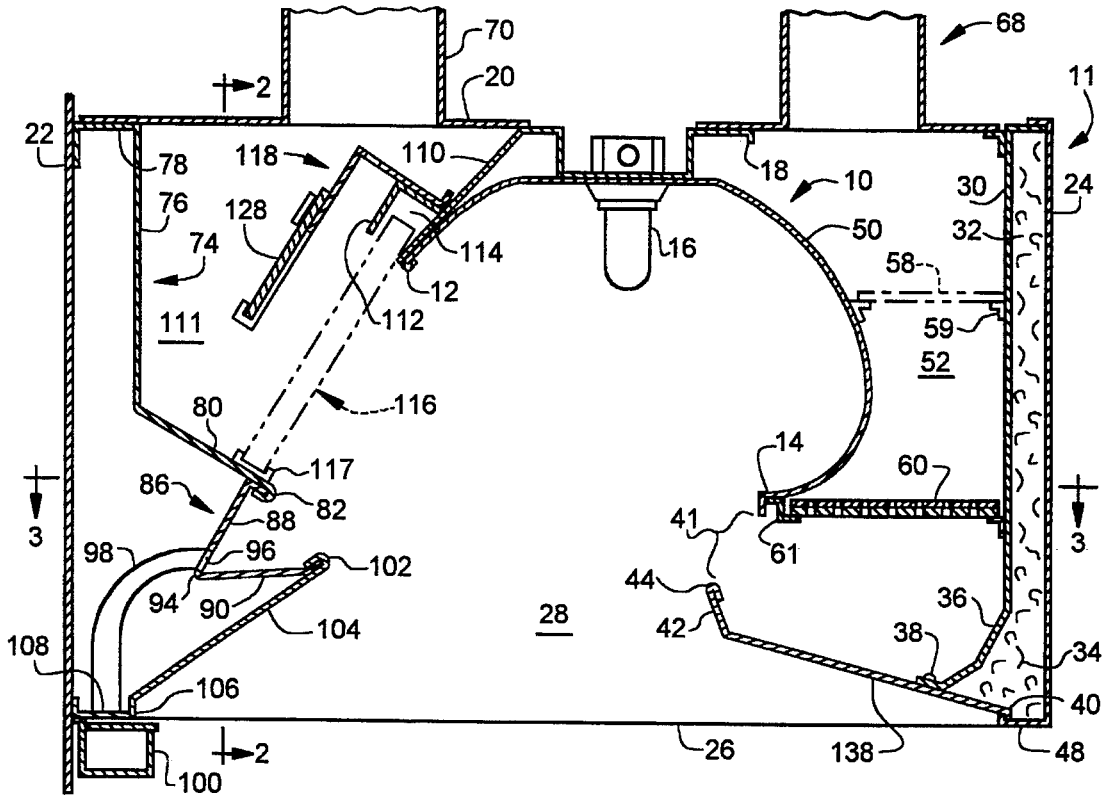
FIG. 1 is a vertical sectional view of the present smoke hood apparatus for removing fumes from the space above cooking appliances, the ceiling of the room in which the smoke apparatus is disposed not being shown.

Referring to FIG. 1, there is shown a housing 11 having a supply air ceiling 18, an exhaust air plenum ceiling 20 and a pair of spaced walls 22 and 24. A vortex liner 10 having edges 12 and 14 is disposed in the interior of the housing 11, the upper portion of the vortex liner 10 being provided with a light 16 which is attached to the supply air plenum ceiling 18. The wall 22 extends downwardly from the exhaust air plenum ceiling 20 to a perimeter 26 of an hood chamber 28. The wall 24 and a plenum wall 30 define a cavity 32 which is filled with insulating material 34. The plenum wall 30 actually functions as a deflecting baffle which extends from the supply air plenum ceiling 18 downwardly and has an arcuate portion 36 having an edge 38 attached to an inclined baffle plate 40 which has an angularly upwardly directed lip 42 which has an edge 44 defining a throat 41 between the edge 44 and the edge 14 of the vortex liner 10. The upper surface of the baffle plate 40 is thermally insulated to prevent cooking vapor condensation on the underside of the baffle plate. Any opposite edge 46 of the baffle plate 40 is attached to a perimeter wall 48 connected to the bottom of the wall 24. Between the supply air plenum ceiling 18, the deflecting baffle 59, a curved wall 50 of the vortex liner 10 and the inclined baffle plate 40, there exists a supply air plenum 52. The supply air plenum 52 extends for about 10 feet from one end 52, as shown in FIG. 3 to another end 56 of the housing 11. At each end of the supply air plenum 52, there are disposed perforated deflector plates 58 supported by brackets. These plates 58 extend between the curved wall 50 of the vortex liner 10 and the plenum wall 30 (FIG. 1) and achieve uniform downward air flow. Also disposed in the supply air plenum 52 are three compensator plate means 60, each extending from the edge 14 of the vortex liner 10 to the plenum wall 30. The compensator plate means 60 are supported by brackets 61. The compensator plate means 60 comprise actually two plates overlapping each other as shown in FIG. 8, wherein plate 62 overlaps plate 64, each plate being provided with a multitude of holes, each hole being ¼" diameter with ⅜" centers. The plates 62 and 64 are movable with respect to each other to provide control of air passing through the compensator plate means 60.

Figure 6B:
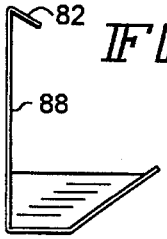
FIG. 6B shows a side view of the grease gutter.
Figure 6A:
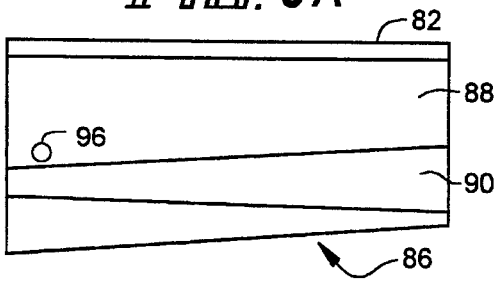
FIG. 6A shows a plane view of a grease gutter.

As shown in FIG. 3, a compensator plate 63 is positioned to control air flow through a portion of the throat 41 in the area just above a broiler section 62*a*, a compensator plate 64 is positioned to control air flow through a portion of the throat 41 in the area just above a fryer section 64*a*, and a compensator plate 66 is positioned to control air flow through a portion of the throat 41 just above a range top 66*a*. The perforated deflector plate 58 is similar in construction to one of the compensator plates and comprises a single plate instead of two movable plates. The supply air plenum ceiling 18 communicates with a supply air duct 68. The exhaust air plenum 20 communicates with an exhaust transition duct 70 which couples with an exhaust duct 71 which extends upwardly out of the building and terminates in an exhaust blower 72 as shown in FIG. 2. The air duct 68 is coupled to an air blower, not shown. Referring to the left side of the apparatus, as shown in FIG. 1, there is an exhaust plenum wall 74, having a vertical section 76 having an edge 78 attached to the exhaust air plenum ceiling 20 and an angularly deflected downward section 80 having a hemmed edge 82, which can be seen in the enlarged view in FIG. 11, wherein the hemmed edge 82 engages an edge 84 of a grease gutter 86 which has an angular wall 88 integrally formed with a sloped bottom 90 which has an edge 92 which is slightly higher than a corner 94 defined by the angular wall 88 and the bottom 90 so that any grease dripping on the bottom 90 will flow toward the corner 94. As shown in FIG. 6, a hole 96 is provided in the angular wall 88 to permit trapped grease to flow over a conduit 98 emptying into a catch 100 as shown in FIG. 1. An edge 92 of the grease gutter 86 is engaged by a hemmed edge 102 of a support member 104 which has a lower end 106 secured to a hood perimeter wall 108 attached to the wall 22. The edge 12 of the vortex liner 10 is attached to a wall member 110 having an upper end supported from the exhaust air plenum ceiling 20. The exhaust plenum wall 74 and the wall member 110 with the edge of the vortex liner 10 define an exhaust plenum 111.

Figure 7A:
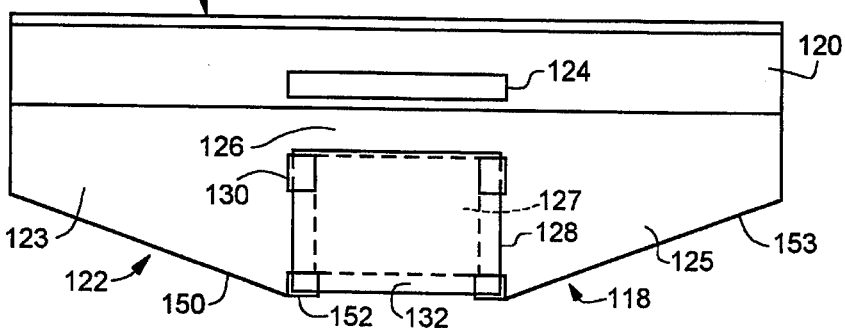
FIG. 7A shows a plane view of an equalizer vane.

Attached to the wall member 110 is an angular member 112 which with the wall member 110 defines a pocket 114 for receiving upper edges of a bank of filters 116, the filters 116 being secured by clips 117 to the hemmed edge 82 of the exhaust plenum wall 74. Secured to the angular member 112 is an "L"-shaped equalizer vane 118, as particularly shown in FIGS. 7-A and 7-B. The equalizer vane 118 has a minor portion 120 and a major portion 122, the minor portion 120, which is an elongated rectangular section, having a centrally located slot 124 which subtends ⅓ of the length of the equalizer vane which extends across the entire length of the exhaust plenum 111. The major portion 122 comprises a central section 126 flanked by angularly configured vanes 123 and 125, each of which extends ⅓ of the entire length of the equalizer vane 118 as shown in FIG. 7A. The central section 126 has an opening 127 which is covered on the underside of the equalizer vane by a damper 128 as shown by the dotted lines, the damper being secured on the underside of the central section 124 by four tabs 130. A removable plate stop 132 prevents the damper 128 from sliding out of the tabs 130. The damper 128 can be moved or slid upwardly to provide an opening in the plane of the opening 127. The equalizer vane 118, as mentioned before, has an "L"-shaped form as viewed in FIG. 7-B. As previously described, the equalizer vane 118 is secured to the angular member 112, as particularly shown in FIG. 1.

Figure 7B:
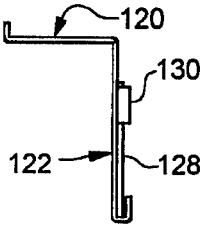
FIG. 7B shows an end view of the equalizer vane.

The present invention employs a bank of filters 116 which are arranged together in abutting relationship as shown in FIG. 9-A. These filters have edges which are cut-away so that they can interlock and overlap with an adjoining filter as shown in FIG. 7-B. The cut-away edges are provided with holes which register with each other so that there is fitting occurring in the overlapped portions. A junction 134 existing between abutting filters 116 is supported at the bottom by the clip 117 secured to the hemmed edge 82 as indicated in FIG. 1.

Figure 4A:
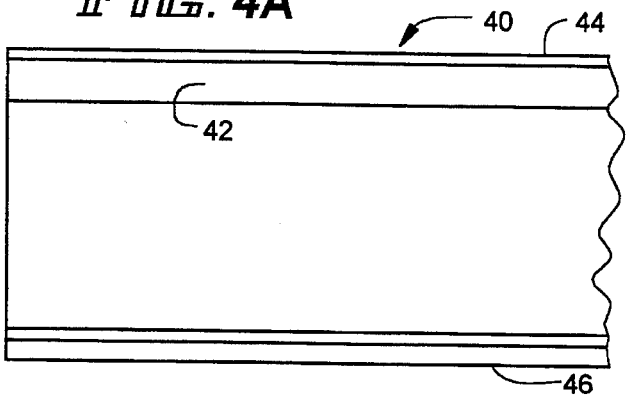
FIG. 4A shows a plane view of a deflecting baffle.
Figure 4B:
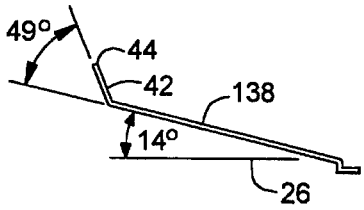
FIG. 4B shows the angular arrangement of the deflecting baffle.

As shown in FIG. 1 and FIG. 4-B, the lip 42 on the baffle plate 40 extends angularly upwardly from a base 138 which extends angularly upwardly to form an angle of about 15° with respect to the perimeter 26. The lip 42 forms an angle of about 49° with respect to the base 138. The configuration of the inclined baffle plate 40 is clearly apparent in FIG. 4-B.

Figure 5A:
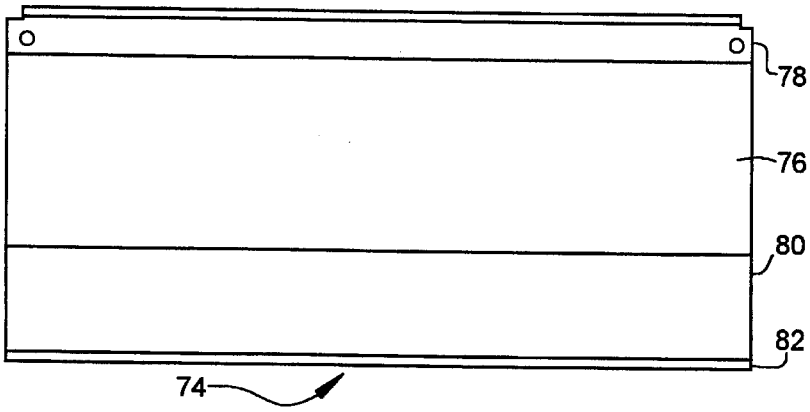
FIG. 5A shows a plane view of an exhaust plenum bottom.
Figure 5B:
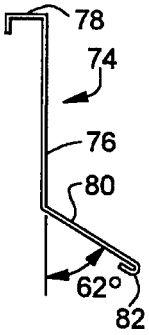
FIG. 5B shows a side view of the exhaust plenum bottom.

The configuration of the exhaust plenum wall 74 is more clearly defined in FIG. 5-B, wherein the angularly deflecting section 80 of the exhaust plenum wall 74 forms of an angle of about 62° with respect to an extension of the vertical section 76.

Referring to FIG. 2, the transition duct 70 is coupled to the exhaust duct 71 providing a flow path for the air exhausted by the exhaust blower 72 which is powered by a motor, not shown, which is controlled by a speed controller (not shown) secured to end 54 of the housing 11. The plenum 144 indicated by the broken line shows the prior art construction which was used as described in the earlier-mentioned U.S. Patent. This invention illustrates the economy of replacing the large plenum 144 by a transition duct 70, the exhaust duct 71 and the horizontally extending exhaust air plenum 148 defined by the ceiling 20 and the equalizer vane 118 channeling the exhaust air to the transition duct 20. A similar saving in construction is achieved in the supply air section by using a similar transition duct 68 and a supply air duct connecting the transition duct to a blower (not shown). The supply air plenum 144, as shown by dotted line in FIG. 2, has been similarly replaced by a simplified construction utilizing a standard duct 71, for example, connecting a blower, for example, as the blower 72 shown in FIG. 2, to a transition duct section to a supply air transition duct 68, conducting the supply air into a supply air plenum 52 which is provided with perforated deflector plates 58 and with perforated compensator plate means 60. The perforated deflector plates 58 comprise two plates, each being positioned on the inside of the hood, and the compensator plate means 60 are positioned above and in alignment with cooking appliances. Since the supply air transition duct 68 is centrally located and extends over ⅓ of the length of the hood chamber 28, the deflector plates 58 function to achieve uniform downward air flow along the sides of the hood chamber 28. The compensator plate means 60 modulate the downward flow of air, that is, cause the air to flow through the perforated compensator plates so that air flows through the compensator plates in an uniform pattern so that, upon being deflected and passed through the throat 41, a prescribed amount of air is introduced into the center of the vortex liner 10 in an area directly above the cooking appliance. If the compensator plates are not used, the supply air entering the supply air plenum 52 would be more strongly concentrated in the central portion of the plenum. Also, the air moving along the angular surface of the supply air transition duct has movement in vertical and horizontal directions. Using the compensator plates 60 tricks most of the horizontal movement of the air so that the air moving past the compensator plates is essentially in a vertically downwardly direction.

OPERATION

As the air supplied by supply air plenum 68 enters the supply air plenum 52 in the housing 11, it flows through perforated deflector plates 58, past compensator plate means 60, along an arcuate portion 36 of the deflecting baffle 30, passes through the throat constriction 41 between the edges 14 and 44, and develops a vortex flow of air in the vortex liner 10 as best viewed, in the prior art shown in FIG. 10. Thereafter, the air passes through the filters 116. A major portion of the air passing through the filter 116 is channeled upwardly by the central section 126 and the damper 128 of the equalizer vane 118 so that the channeled air passes through the slot 124 and enters into the exhaust transition duct 70. Another portion of the air moving through the filter 116 passes under edges 150 and 153 of the equalizer vane 118, shown in FIG. 7, then moves upwardly, and then moves horizontally along the exhaust plenum ceiling 20 inwardly towards the slot 124, and out through the transition duct 70. Another portion of the air passing through the filters 116, mostly in the areas shrouded by the vanes 123 and 125, will move upwardly and then horizontally along an undersurface of the vanes 123 and 125 toward the slot 124. A still further portion of the air passing through the filters 116 will pass under edges 150 and 153, then upwardly toward the exhaust air plenum ceiling 20, and then move horizontally and inwardly toward the exhaust transition duct 70. Since most of the exhaust air passing through the filters 116 is induced by the central section 126 and the damper 128 to flow rapidly through the slot 124, such flow will produce negative pressures at the ends of the slot 124. Such negative pressures cause the remainder of the exhaust air below the exhaust air plenum ceiling 20 in the exhaust air plenum 111 to be drawn inwardly toward the slot 124 for evacuation.

The step of modulating the flow of supply air is achieved by inserting perforated plates in the supply air plenum to impart particular flow characteristics to the supply air. The step of channeling upwardly the exhaust air is achieved by shrouding the filter with the equalizer vane member provided with an exhaust slot communicating with the transition exhaust duct. The method also includes the step of positionally adjusting the perforated plates with respect to each other to control the amount of supply air entering the chamber in the hood.

The following discussion is concerned with the specific improvements achieved with the present invention over the earlier development described in U.S. Pat. No. 3,943,836, previously mentioned.

Referring to FIG. 10, which shows the prior art apparatus, FIG. 10 has been labelled with alphabetic symbols to show the areas where improvements have been achieved with the present invention. During the discussion, any reference made to the prior art structure will be identified by an underlined reference numeral.

Improvement AA: The exhaust plenum bottom end 10 had a trough ("U"-shape channel) for supporting the bottoms of the filters **3*a*, which trough undesirably collected grease buildup along the full length of the trough. This was replaced by the exhaust plenum member 74, which has the hemmed edge 82 provided with a smooth surface enabling unimpeded draining of the grease from the portion 84 into the grease gutter 86**.

Improvement BB: Shows a narrow trough or gutter 11 for conducting the grease to a catch. Occasionally, this trough overflowed. The improvement comprises a grease gutter 86, which is provided with a conduit 98 leading into a grease catch 100 (FIG. 2).

Improvement CC: Shows exhaust air flow moving through the filters **3*a* directly into a plenum 150 which extended over the entire length of the apparatus. The prior art plenum 150, as shown by the broken line 144 in FIG. 2 of the present application, was replaced by the plenum 111, the transition duct 70, and the equalizer vane 118**.

Improvement DD: Shows the prior deflector 46 with a gap 23 at the bottom permitting flow of air under the baffle plate 18, wherein the supply air is split into two flows, one flow passing through the throat 12 and the other flow passing under the baffle 18. The improvement comprises the deflecting baffle 30 provided with the arcuate portion 36, and thus eliminating the gap 23 at the bottom, and providing the inclined baffle plate 40 having one of its surfaces lined with thermal insulating material. Preferably, insulation is added to the top surface of the baffle for use in extremely cold climates. This eliminates the previously required air flow through the gap 23 forming an air curtain on the underside of the baffle plate 18 to prevent condensation of vapors rising from the cooking appliances.

The deflecting baffle 30 shows the arcuate portion 36 melding with the baffle plate 40. This change eliminated the previous acute angle formed between the baffle 18 and wall 46 that caused turbulence with the rapid air flow leaving the deflecting baffle. The improved air flow stabilizes the negative pressure along the leading edge 14 of the curved vortex liner 10, which improved air flow, in turn, creates a more forceful vortex action. This achieves a close balance between the supplied and exhausted air. Because of this, with no heated thermal air entering the hood (cold appliance), a volume of supplied air equal to the volume exhausted can be delivered into the hood without the air falling below the perimeter 26 of the hood chamber 28. This improved design allows the use of variable speed exhaust and supply air blower motors to adjust the air at various outdoor temperatures. Underwriters Laboratories have conducted tests which show that less exhausted air and more supplied air can be used at low outdoor temperatures. This means that less thermal replacement air is required from the heated kitchen. Less heated replacement air means energy saved, and thus greater energy efficiency.

Improvement EE: Shows the prior art vortex liner 31 having a structure with a portion 51 defining with the baffle plate 18 a nozzle opening 53, which structure has been improved by eliminating the lower portion 51 of the vortex liner 31, extending the length of the baffle plate 40 and by uplifting the lip 42 on the inclined baffle plate 40 to direct the flow of air into the center of the vortex liner 10 to improve the swirling of air in the vortex liner.

Improvement FF: Shows the positioning of compensator plate means 60, provided with ¼" holes, in the supply air plenum 52, between the vortex liner 10 and the deflecting baffle 30. A multiple of these plate means are used to modulate the air moving uniformly along the length of the deflecting baffle plate 40. The hole size in the compensator plate means 60 serves as a fixed valve for the incoming supplied air. The hole size in each compensator plate means is determined by the nature of the thermal air arising from the appliance. The compensator plate means 60 control the amount of air supplied above the appliance for capturing the particulate matter rising from the appliance within the hood chamber 28. Since the holes in the compensator plate means are staggered, a pair of plates with the same hole size can be stacked to reduce the open area of the plates. The apparatus described in the aforementioned U.S. Patent had no control over the supply air moving into the supply chamber 11.

Improvement GG: Shows the perforated deflector plates 58 installed in the supply air plenum 52 at the left and right ends 54 and 56 of the hood chamber 28, as shown in FIG. 3. These plates achieve uniform downward air flow.

Improvement JJ: Shows a bank of four filters 3*a* adjacent each other, each intermediately positioned filter abutted a filler section so that in a bank of four filters, three filler sections were used to couple the filters together. This type of arrangement decreased the capability of the bank of filters functioning at a 100% efficiency because of the lost area created by the use of filler sections. Furthermore, as previously mentioned, the swirling air that was directed into the face of the bank of filters was deflected downwardly and tended to create an obstruction to the other incoming swirling air directed toward the bank of filters. The present invention does not use any filler sections because each filter has an abutting side with an adjacent filter, each adjoining side having an undercut portion to overlap a similarly but oppositely undercut portion of the adjoining filter. Therefore, the passage of air with the fumes through the entire bank is fully unobstructed. It is to be understood that the overlapping portions of the filter also possess openings which match with openings in the other overlapped undercut portion of the adjoining filter. In other words, there is no dead spot that prevents flow of air in the area occupied by the overlapped portions of the abutting filters.

The foregoing detailed description is to be clearly understood as given by a way of illustration and example only, the spirit and scope of this invention being limited solely by the appended claims.

I claim:

1. A method of removing cooking fumes and odors from an area above a cooking appliance located in a kitchen area, wherein supplied air passes through a supply air plenum into an interior of a hood, partly defined by a vortex liner, and exits through filter means in an exhaust plenum and is then exhausted exteriorly of the kitchen area, comprising the steps of:

modulating the flow of the supply air through the supply air plenum, directing air flow from the supply air plenum toward a chamber in the hood, deflecting and increasing the velocity of the supply air to create a vortex flow to capture rising fumes and smoke entering a hood chamber, directing the supply air, contaminated with the fumes and smoke, through said filter means into the exhaust plenum, channeling exhaust air upwardly after passing through the filter means, and directing the flow of the exhaust air along a horizontal path toward a transition exhaust duct, wherein the step of modulating the flow of supply air is achieved by inserting perforated plates in the supply air plenum to impart particular flow characteristics to the supply air, including the step of positionally adjusting the perforated plates with respect to each other to control the amount of supply air entering the chamber in the hood.

2. A fume and odor collecting hood adapted to be mounted above a cooking appliance in a cooking area, comprising:

a housing having a hood chamber and a vortex liner adapted to receive fumes and cooking odors generated by the cooking appliance, grease filter means mounted in said housing for removing fume and odor permeated air, exhaust air duct and blower means to draw the permeated air through said filter means from said chamber in the hood for discharge to a region exterior of the cooking area, supply air duct and blower means connected to said housing for supplying air directly to said housing from a region exterior of the cooking area, deflecting means defining one wall of said housing, the supply air duct means including a supply air plenum defined by full lengths of the vortex liner and said deflecting means, exhaust air plenum wall means defining another wall of said housing, said exhaust air duct means including an exhaust air plenum defined by full lengths of the vortex liner and said exhaust air plenum wall means, and equalizer vane means provided with a centrally located exhaust air opening extending longitudinally above the grease filter means, said equalizer vane means for conducting outwardly the odor permeated air passing through said filter means.

3. The invention as claimed in claim 2, said supply air duct including compensator means disposed in the supply air plenum, said compensator means extending between a wall of the vortex liner and said deflecting means, said deflecting means extending longitudinally along the length of the vortex liner and having a deflector edge defining with an edge of the wall of the vortex liner a constricting air vortex-producing throat.

4. The invention according to claim 3, said compensator means comprising a pair of perforated balancing plates situated in the upper portion of said supply air plenum, one at each end of said plenum, and extending between said wall of said vortex liner and said deflection means, and a plurality of sets of overlapped perforated deflector plates, movable with respect to each other, and extending in a lower portion of said supply air plenum, between said wall of said vortex liner and said deflecting means.

5. The invention according to claim 3, said deflecting means defining a vertical plenum wall and having an arcuate portion connected to an inclined baffle plate having a lip defining said deflector edge.

6. The invention according to claim 5, wherein said baffle plate has a base portion which angularly projects upwardly from a perimeter of the bottom of the hood by about 15° and said lip projects angularly upwardly from said base portion by about 49°, pointing substantially toward a core of the space defined by said vortex liner.

7. The invention according to claim 2, wherein said exhaust air plenum wall means comprise a vertical section and an angular downwardly deflected section having a downwardly directed hem, a grease gutter disposed below said angular downwardly deflected section and supported from said hem and a support member, and draining means for collecting the grease.

8. The invention according to claim 7, including mounting clips associated with said hem for supporting said filter means on said angular downwardly deflector section.

9. The invention according to claim 2, wherein said equalizer vane means comprise a plate structure having a minor portion bent at 90° to a major portion and having a central portion provided with an exhaust air opening, said major portion having a centrally located section provided with a cut-out, a damper covering said cut-out, means for slidably retaining said damper on said centrally located section, vanes extending outwardly from said centrally located section, each vane having an edge angularly extending from a bottom of said centrally located section in a direction outwardly and toward a side of said plate structure to define a truncated right triangle.

10. The invention according to claim 9, wherein said exhaust air opening subtends ⅓ of the length of the plate structure and the cut-out subtends ⅓ of the length of the plate structure.

11. The invention according to claim 9, including means for supporting said plate structure in said exhaust air plenum, above said filter means at a predetermined shrouding position.

12. In an apparatus for filtering fumes in the space above a cooking appliance, said apparatus comprising a hood, a supply air plenum and an exhaust air plenum in said hood, supply air means communicating with said supply air plenum for providing a supply of air to the hood, an exhaust air means communicating with said exhaust air plenum for exhausting contaminated air from said hood, and filter means adjacent said exhaust air plenum for filtering grease from said contaminated air, the improvement wherein said supply air means comprise a supply air duct, a supply air transition duct, and compensator means, said supply air transition duct connecting said supply air duct to said supply air plenum, said compensator means being disposed in a flow path of said supply air, said exhaust air means comprise an exhaust air duct, an exhaust air transition duct, and equalizer vane means, said exhaust air transition duct connecting the exhaust air duct to said exhaust air plenum, said equalizer vane means having a centrally located exhaust air opening and being disposed in said exhaust air plenum, and means for securing said equalizer vane means above said filter means at a predetermined distance therefrom, to direct the exhaust air, passing through the filter means, under the equalizer vane means toward said exhaust opening.

13. The invention according to claim 12, said compensator means comprising a pair of perforated balancing plates, means for securing each plate in an upper portion of said supply air plenum at each end of said supply air plenum, a plurality of pairs of overlapping perforated deflecting plates, the plates in each pair being movable with respect to each other, and means for securing said pairs of plates, each set of plates spaced from each other, on the same level in a lower portion in said supply air plenum.

14. The invention according to claim 12, said equalizer vane means comprising a plate structure having a minor portion bent at a 90° angle to a major portion and having a central portion provided with an exhaust air opening, said major portion having a centrally located section provided with a cut-out, a damper covering said cut-out, means for slidably securing said damper on said centrally located section, vanes having swept-back edges, said edges extending outwardly from a bottom of said central section and toward sides of said plate structure to define truncated right triangles.

15. The invention according to claim 14, wherein said central portion has a length equal to about ⅓ of the length of said plate structure.

16. The invention according to claim 14, wherein said exhaust air opening is a slot having a length equal to about the length of said central section.

17. An apparatus as claimed in claim 12, wherein each supply air transition duct and each exhaust air transition duct extend to about ⅓ of the length of the hood and are centrally located in said hood.

18. An apparatus as claimed in claim 12, wherein the supply air transition duct communicates with the central portion of the supply air plenum and the exhaust air transition duct communicates with the central portion of the exhaust air plenum.

19. An apparatus as claimed in claim 18, wherein the exhaust air transition duct registers with the exhaust air opening.

20. In an apparatus for filtering fumes in the space above a cooking appliance, a housing defining a hood, a vortex liner contained in said hood, a supply air plenum and an exhaust air plenum in said hood, supply air means communicating with said supply air plenum for providing a supply of air to the hood, an exhaust air means communicating with said exhaust air plenum for exhausting contaminated air from said hood, and filter means for filtering grease from said contaminated air, the improvement wherein said supply air means comprise a supply air duct, a supply air transition duct, and compensation means, said supply air transition duct coupling said supply air duct to said supply air plenum, said compensator means being disposed in a flow path of said supply air, said exhaust air means comprise an exhaust air duct, an exhaust air transition duct, and equalizer vane means, said exhaust air transition duct connecting the exhaust air duct to said exhaust air plenum, said equalizer vane means, having a centrally located exhaust air opening, being disposed in said exhaust air plenum, and means for securing said equalizer vane means above said filter means, at a predetermined distance therefrom, to direct the exhaust air passing through said filter means, under the equalizer vane means, toward said exhaust opening.

21. An apparatus as claimed in claim 20, said compensator means comprising a pair of perforated balancing plates, means for securing each plate in an upper portion of said supply air plenum at each end of said supply air plenum, a plurality of pairs of overlapping perforated deflector plates, the plates in each pair being movable with respect to each other, and means for securing said pairs of plates, spaced from each other, on the same level in a lower portion in said supply air plenum.

22. An apparatus as claimed in claim 20, said equalizer vane means comprising a plate structure having a minor portion bent at a 90° angle to a major portion and having a central portion provided with said exhaust air opening, said major portion having a centrally located section provided with a cut-out, a damper covering said cut-out, means for slidably securing said damper on said centrally located section, vanes having swept-back edges, said edges extending outwardly from a bottom of said central section and toward sides of said plate structure to define truncated right triangles.

23. An apparatus as claimed in claim 22, wherein said exhaust opening is a slot having a length equal to about the length of said central section.

24. An apparatus as claimed in claim 22, wherein said central portion has a length equal to about ⅓ of the length of said plate structure.

25. A method of removing cooking fumes and odors from an area above a cooking appliance located in a kitchen area, wherein supplied air passes through a supply air plenum into an interior of a hood, partly defined by a vortex liner, and exits through filter means in an exhaust plenum and is then exhausted exteriorly of the kitchen area, comprising the steps of:

modulating the flow of the supply air through the supply air plenum, directing air flow from the supply air plenum toward a chamber in the hood, deflecting and increasing the velocity of the supply air to create a vortex flow to capture rising fumes and smoke entering a hood chamber, directing the supply air, contaminated with the fumes and smoke, through said filter means into the exhaust plenum, channeling upwardly exhaust air after passing through the filter means, and directing the flow of the exhaust air along a horizontal path toward a transition exhaust duct, wherein the step of channeling the exhaust air after passing through the filter means, is obtained by baffling the exhaust air across the full length of the exhaust air plenum, and directing the exhaust air to a centralized transition exhaust duct, wherein the step of channeling upwardly the exhaust air is achieved by shrouding the exhaust air flowing out of said filter means with an equalizer vane provided with an exhaust slot communicating with said transition exhaust duct.

* * * * *